US009512638B2

(12) United States Patent
Clifford et al.

(10) Patent No.: US 9,512,638 B2
(45) Date of Patent: Dec. 6, 2016

(54) LEAF SPRING LOCK CYLINDER

(71) Applicant: Schlage Lock Company LLC, Indianapolis, IN (US)

(72) Inventors: Jason Curtis Clifford, Colorado Springs, CO (US); Brian Andrew Rappl, St. Louis Park, MN (US)

(73) Assignee: Schlage Lock Company LLC, Indianapolis, IN (US)

( * ) Notice: Subject to any disclaimer, the term of this patent is extended or adjusted under 35 U.S.C. 154(b) by 0 days.

(21) Appl. No.: 14/617,869

(22) Filed: Feb. 9, 2015

(65) Prior Publication Data

US 2015/0225981 A1 Aug. 13, 2015

Related U.S. Application Data

(60) Provisional application No. 61/937,352, filed on Feb. 7, 2014.

(51) Int. Cl.

*E05B 27/00* (2006.01)
*E05B 11/00* (2006.01)
*E05B 15/04* (2006.01)

(52) U.S. Cl.

CPC ..... *E05B 11/00* (2013.01); *E05B 27/00* (2013.01); *E05B 27/005* (2013.01); *E05B 27/0017* (2013.01); *E05B 2015/0458* (2013.01); *Y10T 70/7588* (2015.04)

(58) Field of Classification Search

CPC E05B 27/005; E05B 27/0017; E05B 27/0082; E05B 27/0042; E05B 27/00; E05B 27/0003; E05B 27/0057; E05B 27/0078; E05B 11/00; E05B 2015/0458; Y10T 70/7605;Y10T 70/7599; Y10T 70/7588; Y10T 70/7565; Y10T 70/7616; Y10T 70/7881; Y10T 70/7864; Y10T 70/774; Y10T 70/7734; Y10T 70/7638; Y10T 70/7684; Y10T 70/7593; Y10T 70/7661; Y10T 70/7944; Y10T 70/7701; Y10T 70/7559

USPC ..... 70/490–496, 350, 358, 378, 367, 369, 70/375

See application file for complete search history.

(56) References Cited

U.S. PATENT DOCUMENTS 2,687,638 A * 8/1954 Abernathy ..... E05B 27/08 70/447
3,648,492 A * 3/1972 Walters ..... E05B 27/083 70/383
3,702,550 A 11/1972 Shimizu
(Continued)

*Primary Examiner* — Suzanne Barrett
*Assistant Examiner* — Morgan McClure
(74) *Attorney, Agent, or Firm* — Taft Stettinius & Hollister LLP

(57) ABSTRACT

A lock cylinder generally including a shell, a plug positioned within the shell, a locking member, and a leaf spring. The plug includes an opening which is aligned with a recess formed in the shell. The locking member is configured to selectively prevent rotation of the plug with respect to the shell. The leaf spring is positioned in the opening and includes a first portion extending radially inward toward the keyway, and a second portion extending radially outward toward the recess. When a key is inserted, a tip of the second portion extends into the recess. When the plug is subsequently rotated, a tapered surface of the recess urges the tip radially inward and into contact with an inner surface of the shell.

19 Claims, 7 Drawing Sheets

(56) References Cited

U.S. PATENT DOCUMENTS 3,729,964 A * 5/1973 Hsu ..... E05B 27/0032 70/338
3,938,358 A * 2/1976 Doyle ..... E05B 15/1614 70/358
4,075,879 A * 2/1978 Christopher ..... E05B 29/00 70/337
4,083,210 A * 4/1978 Bergin ..... E05B 27/00 70/161
4,122,694 A 10/1978 Gretler
4,300,374 A * 11/1981 Mullich ..... E05B 11/00 70/134
4,369,642 A 1/1983 Grell
4,440,010 A * 4/1984 Guiraud ..... E05B 17/0058 70/407
4,530,222 A * 7/1985 Harper ..... E05B 21/063 70/375
4,776,187 A * 10/1988 Evans ..... E05B 67/24 70/369
4,823,575 A * 4/1989 Florian ..... E05B 27/00 70/358
5,016,455 A 5/1991 Hennessy
5,479,800 A 1/1996 Myers
5,513,509 A 5/1996 Bergen
6,474,122 B2 * 11/2002 Davis ..... E05B 65/0014 70/278.3
6,523,382 B1 * 2/2003 Dimig ..... C23C 16/455 70/419
6,880,376 B1 * 4/2005 Ko ..... E05B 29/0013 70/366
8,099,988 B1 * 1/2012 Wheatland ..... E05B 27/005 70/340
2005/0072197 A1 * 4/2005 Evans ..... E05B 9/086 70/375
2010/0212383 A1 * 8/2010 Stuart ..... E05B 27/0017 70/493
2011/0252846 A1 10/2011 Hertel et al.
2013/0276490 A1 * 10/2013 Nguyen ..... E05B 27/0039 70/358
2014/0190223 A1 * 7/2014 Field ..... E05B 35/003 70/493
2014/0216114 A1 * 8/2014 Clifford ..... E05B 19/0029 70/490

* cited by examiner

LEAF SPRING LOCK CYLINDER

CROSS REFERENCE TO RELATED APPLICATIONS

The present application claims the benefit of U.S. Provisional Patent Application No. 61/937,352 filed on Feb. 7, 2014, the contents of which are incorporated herein by reference in their entirety.

TECHNICAL FIELD

The present disclosure generally relates to locks, and more particularly, but not exclusively, to classroom-type lock cylinders.

BACKGROUND

In certain settings such as schools, it is often desirable that doors have the ability to be locked in emergency situations or lockdowns by any faculty or staff member. While certain conventional systems employ a thumb-turn or a similar apparatus on the interior side of the door, it may be desirable to permit only certain individuals to lock and unlock the door. It may also be desirable that the lock be able to perform basic functions such as securing the door and retaining the key within the plug while the lock is being operated. Certain conventional lock cylinders may be unable to provide one or more of these features. Therefore, a need remains for further contributions to this area of technology.

SUMMARY

A lock cylinder generally includes a shell, a plug positioned within the shell, a locking member, and a leaf spring. The plug includes an opening which, is aligned with a recess formed in the shell. The locking member is configured to selectively prevent rotation of the plug with respect to the shell. The leaf spring is positioned in the opening and includes a first portion extending radially inward toward the keyway and a second portion extending radially outward toward the recess. When a key is inserted, a tip of the second portion extends into the recess. When the plug is subsequently rotated, a tapered surface of the recess urges the tip radially inward and into contact with an inner surface of the shell. Further embodiments, forms, features, and aspects of the present application shall become apparent from the description and figures provided herewith.

DETAILED DESCRIPTION OF ILLUSTRATIVE EMBODIMENTS

Figure 1:
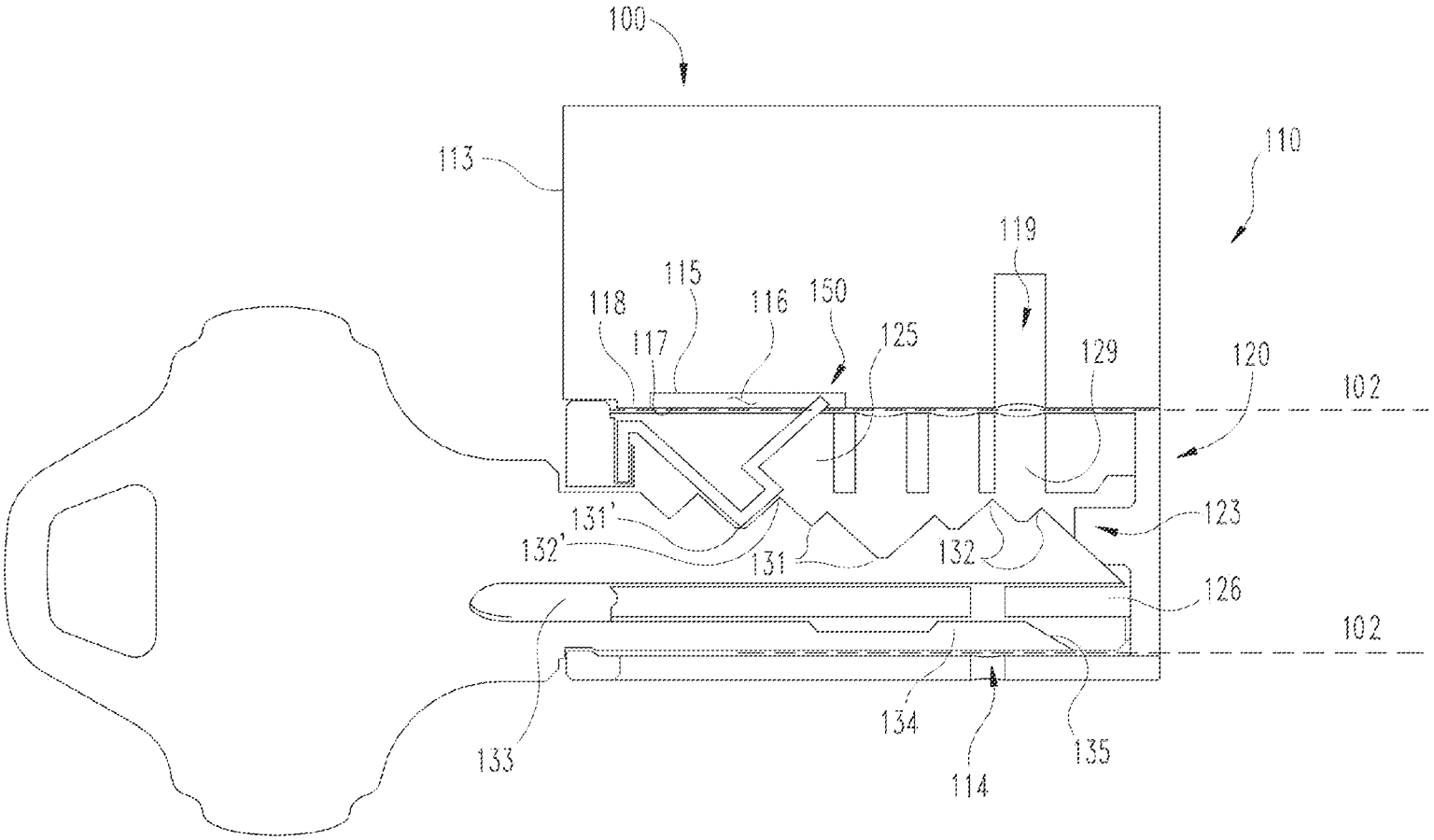
FIG. 1 is a longitudinal cross-sectional illustration of a lock cylinder according to one embodiment.

For the purposes of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates.

Figure 2:
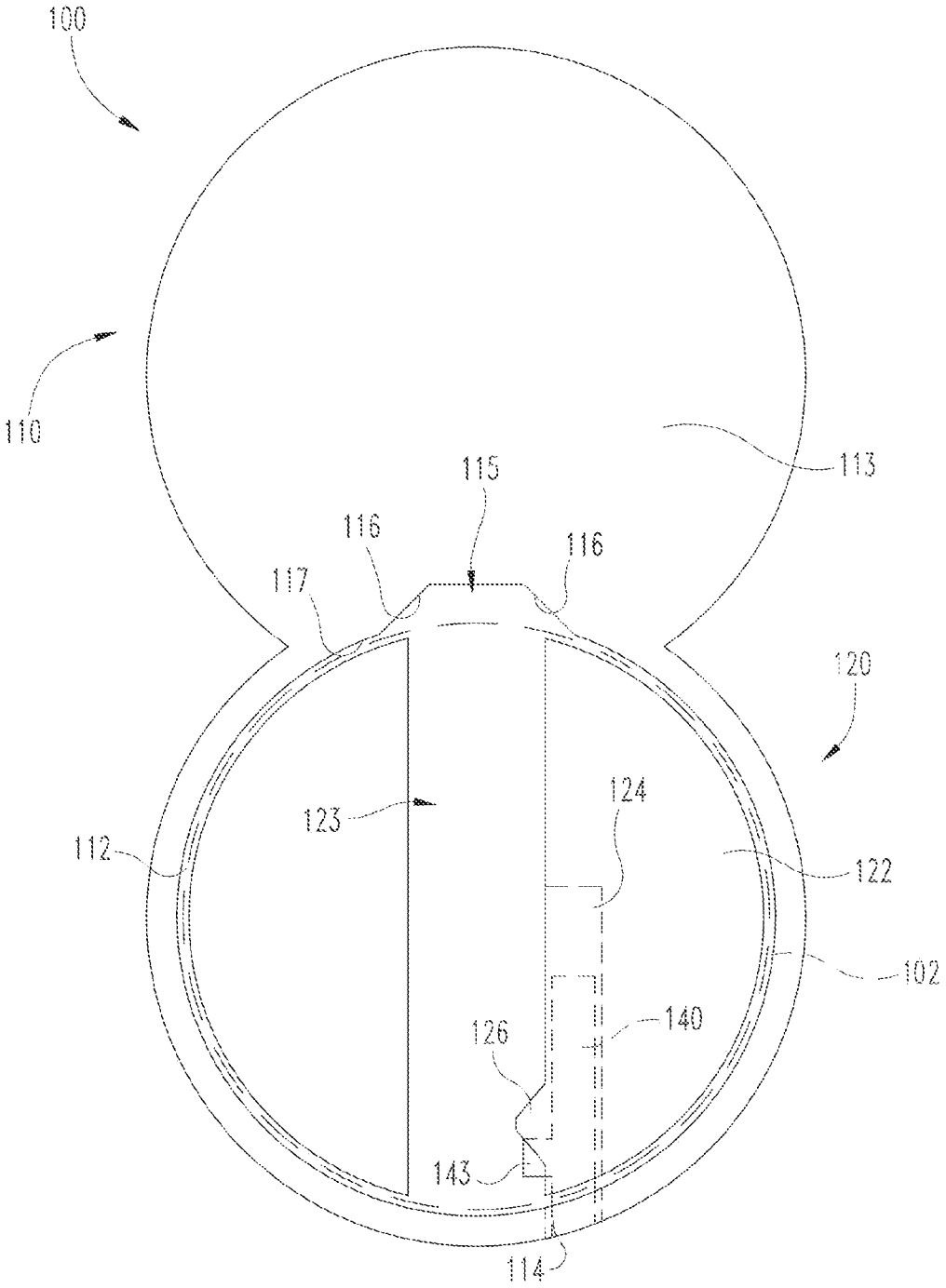
FIG. 2 is an axial cross-sectional illustration of the lock cylinder illustrated in FIG. 1.
Figure 3:
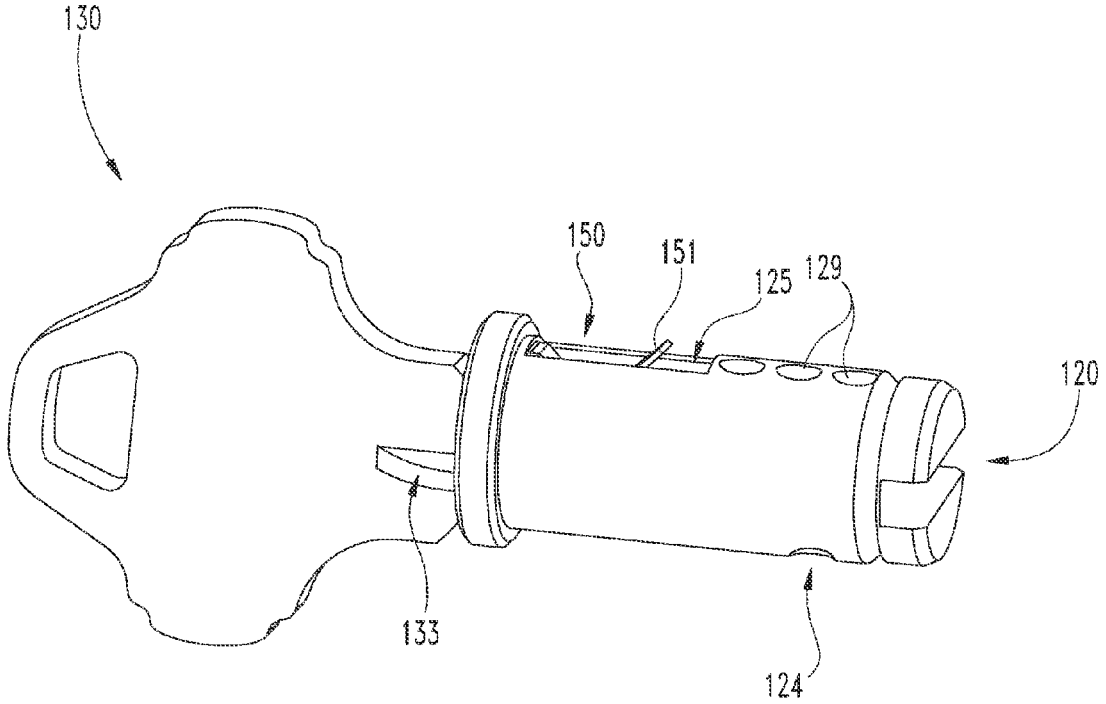
FIG. 3 is a perspective illustration of one embodiment of a lock plug used in the lock cylinder illustrated in FIG. 1.

With reference to FIGS. 1-3, illustrated therein is a lock cylinder 100 generally including a shell 110 and a plug 120. The plug 120 is disposed within the shell 110 such that a shear line 102 is formed between the shell 110 and the plug 120. The cylinder 100 is operable in a blocked state in which rotation of the plug 120 is substantially prevented, and an unblocked state in which rotation of the plug 120 is permitted. The cylinder 100 is biased to the blocked state and is configured to transition from the unblocked state upon insertion of a proper key 130. When the key 130 is inserted and the plug 120 is rotated, the plug 120 may engage an armature (not shown) configured to throw a latch or bolt toward an extended position and/or a refracted position.

The shell 110 includes a generally cylindrical chamber 112 within which the plug 120 is positioned. The shell 110 may further include a tower 113 configured to provide the shell 110 with a geometry corresponding to that of a cylinder housing (not shown). In the illustrated embodiment, the configuration of the shell 110 enables the cylinder 100 to be installed in a small format interchangeable core (SFIC) housing. It is also contemplated that the shell 110 may be of another suitable configuration and the cylinder 100 of another suitable format. For example, the shell 110 may be of a standard configuration such as, for example, full size, large format, mortise, rim, or key-in-knob/lever. The shell 110 further includes a recess 115 defined in part by tapered surfaces 116 which connect a shell inner surface 117 to the inner surface of the recess 115. The shell 110 may further include a check pin cavity 114 and a protrusion 118 configured to prevent insertion of a foreign object into the recess 115.

The plug 120 includes a keyway 123 and a spring opening 125, and may further include a check pin cavity 124. When the plug 120 is positioned in a home position (FIG. 1), the plug check pin cavity 124 is aligned with the shell check pin cavity 114, and the spring opening 125 is aligned with the recess 115. The illustrated plug 120 also includes a leaf spring 150 positioned at least partially within the spring opening 125, and a check pin 140 positioned at least partially within the plug check pin cavity 124. As described in further detail below, the check pin 140 is configured to selectively prevent rotation of the plug 120 with respect to the shell 110. The plug 120 may further include a ward 126 configured to prevent insertion of a key which does not include a correspondingly-shaped groove, such as the groove 133 on the illustrated key 130.

The key 130 includes an edge cut comprising a plurality of bittings 131 separated by teeth 132. One of the bittings 131 is an engagement bitting 131' positioned adjacent an engagement tooth 132', which together define a leaf spring engaging section of the key 130. In the illustrated embodiment, the engagement bitting 131' is defined at the second bitting position of the key 130, although other bitting positions are contemplated for the engagement bitting 131'. The function of the engagement bitting 131' and the engagement tooth 132' is described below.

In the illustrated embodiment, the key 130 further includes a groove 133 having a shape corresponding to that of the ward 126. The groove 133 is formed on a broad side surface of the key 130, and is defined in part by a ridge 134. As described in further detail below, the ridge 134 is configured to engage the check pin 140, and may thus be considered a locking member engaging portion of the key 130. In the illustrated form, the ridge 134 extends substantially the length of the key shank and terminates at a ramp 135 near a tip of the key 130. It is also contemplated that the ridge 134 may not necessarily extend substantially the length of the shank so long as the ridge 134 substantially aligns with the check pin cavity 124 when the key 130 is fully inserted into the plug 120. In further embodiments, such as those which do not include the check pin 140, the ridge 134 may be of another configuration or may be absent.

As illustrated in FIG. 2, the check pin 140 is positioned at least partially within the plug check pin cavity 124, and includes an arm 143 which protrudes into the keyway 123 to interact with the ridge 134. When no key is inserted (FIG. 2), the check pin 140 is in a blocking state wherein the check pin 140 extends into the shell check pin cavity 114 and crosses the shear line 102 of the cylinder 100. In the blocking state, the check pin 140 prevents rotation of the plug 120 with respect to the shell 110, and the cylinder 100 is positioned in the blocked state.

When the key 130 is inserted, the arm 143 is urged upward as it travels along the ramp 135 to the ridge 134. When the arm 143 is in contact with the ridge 134, the check pin 140 is positioned in an unblocking state and does not cross the shear line 102 into the shell check pin cavity 114. This position of the check pin 140 defines an unblocked state of the cylinder 100 in which the plug 120 is rotatable with respect to the shell 110. It should be understood that configurations of the check pin 140 and the ridge 134 described herein are exemplary only, and certain embodiments may include additional and/or alternative features such as those described in U.S. Pat. No. 5,715,717 to Widen.

In the illustrated form, the check pin 140 is operable to adjust the cylinder 100 between the blocked state and the unblocked state. Certain embodiments may include additional or alternative locking members for selectively preventing rotation of the plug 120 with respect to the shell 110. As described in further detail below, the locking member or members are preferably configured to cross the shear line 102 when the key 130 is not fully inserted, thereby requiring full insertion of the key 130 for rotation of the plug 120. In certain embodiments, the shell 110 and plug 120 may include one or more tumbler cavities 119, 129, and a tumbler system (not shown) may selectively prevent rotation of the plug 120. In the illustrated embodiment, the tumbler cavities 119, 129 are configured to house pin tumblers, although it is also contemplated that other types of tumblers (i.e., wafer and/or disc tumblers) may be used, and that the tumbler cavities 119, 129 may be sized and configured accordingly.

Figure 4:
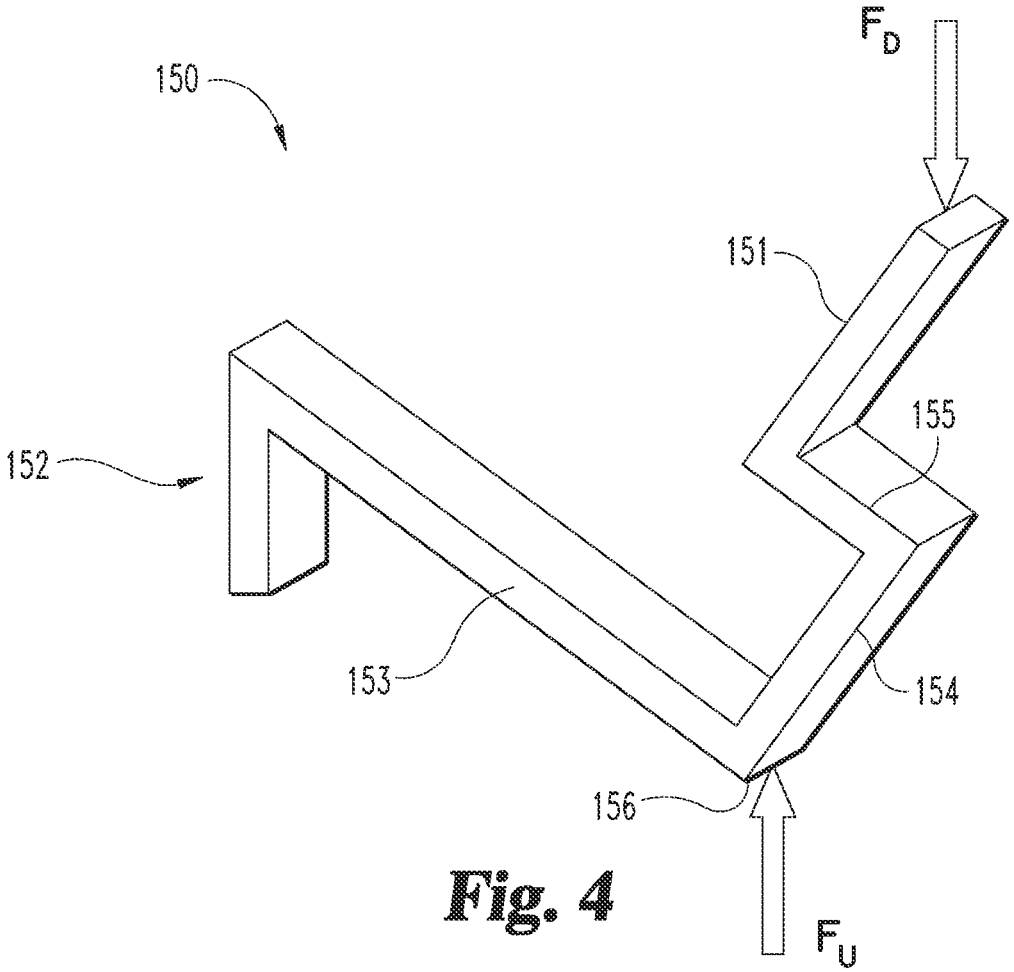
FIG. 4 is a perspective illustration of a leaf spring according to one embodiment.

With additional reference to FIG. 4, an illustrative leaf spring 150 includes a tip portion 151, a base portion 152, a first leg 153, a second leg 154, a third leg 155, and a vertex 156 at the junction of the first and second legs 153, 154. When the leaf spring 150 is installed, the base portion 152 is coupled to the plug 120 at a proximal side of the spring opening 125, and each of the legs 153-155 extends in both a longitudinal direction and a radial direction. More specifically, the first leg 153 extends distally and radially inward from the base portion 152 such that the vertex 156 is received in the keyway 123. The second leg 154 extends distally and radially outward from the vertex 156, and the third leg 155 extends proximally and radially outward from the second leg 154. A fourth leg defines the tip portion 151 which extends distally and radially outward from the third leg 155.

The illustrative leaf spring 150 is a z-shaped leaf spring formed of a flexible and resilient material, and is configured such that a general downward force $F_D$ applied to the tip portion 151 or a generally upward force $F_U$ applied in the vicinity of the vertex 156 will cause the leaf spring 150 to elastically deform. When the tip portion 151 is free to travel, this elastic deformation results in the leaf spring 150 pivoting about the proximal end of the first leg 153, which is in turn connected to the base portion 152.

When the illustrated leaf spring 150 is in a natural or undeformed state, the first leg 153 and third leg 155 are arranged substantially parallel to one another, and the tip portion 151 and the second leg 154 are arranged substantially perpendicular to the first leg 153 and the third leg 155. In certain embodiments, one or more of the legs 153, 154, 155 may define an oblique angle with respect to another of the legs 153, 154, 155 and/or the tip portion 151. The unique shape of the leaf spring 150 allows the key 130 to be inserted and removed easily when the tip portion 151 is free to travel (e.g., when the downward force $F_D$ is not being applied). However, once an appropriate downward force $F_D$ is applied, the key 130 cannot be removed. With reference to FIGS. 5-8, further details regarding this feature are provided below.

Figure 5:
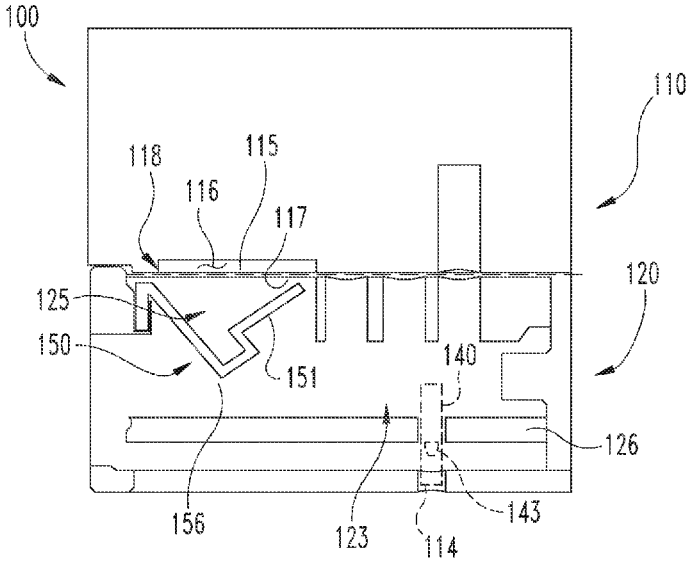
FIG. 5 depicts the lock cylinder in a first state in which no key is inserted and the plug is positioned in a home position.

FIG. 5 illustrates the plug 120 positioned in the home position with no key inserted. Because no key has been inserted, the cylinder 100 is positioned in the blocked state due to the check pin 140 crossing the shear line 102 and extending into the shell check pin cavity 114. Additionally, with no key inserted, the leaf spring 150 is positioned in its natural or undeformed state. In the natural state of the leaf spring 150, the vertex 156 extends into the keyway 123 such that the distance between the vertex 156 and the opposing surface of the keyway 123 is less than the root depth of the key 130 at the tip of the engagement tooth 132'.

Figure 6:
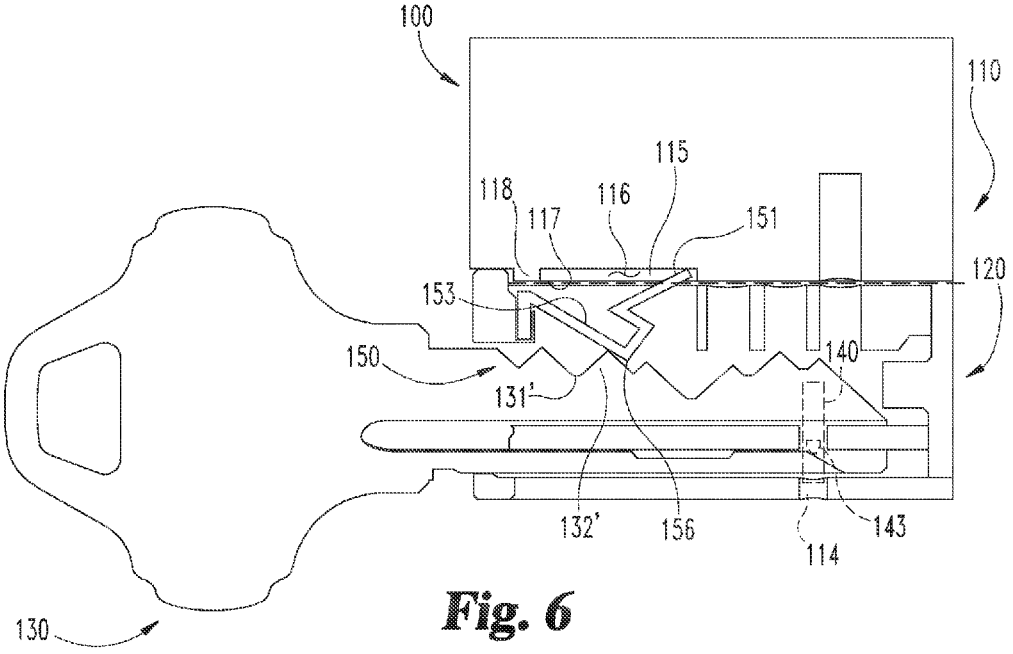
FIG. 6 depicts the lock cylinder in a second state in which a key is partially inserted into the plug.

FIG. 6 illustrates the key 130 partially inserted into the plug 120. As the key 130 is inserted, the ramp 135 engages the arm 143, thereby urging the check pin 140 away from the shell check pin cavity 114. Insertion of the key 130 also causes the vertex 156 to travel along the top cut of the key 130, thereby resulting in elastic deformation of the leaf spring 150. When the engagement tooth 132' contacts the vertex 156, the leaf spring 150 is deformed to a state in which the tip portion 151 extends into the recess 115. The tip portion 151 may contact the inner surface of the recess 115, which may in turn cause additional deformation.

Figure 7:
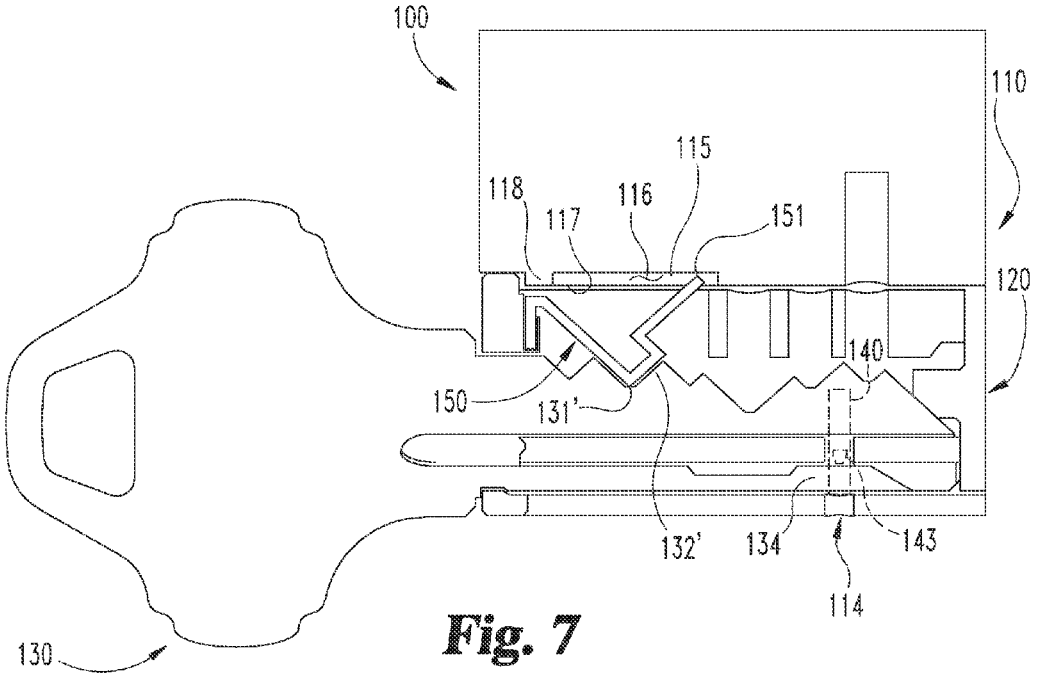
FIG. 7 depicts the lock cylinder in a third state in which the key is fully inserted into the plug.

FIG. 7 depicts the cylinder 100 with the key 130 fully inserted into the plug 120. In this state, the tip portion 151 remains at least partially positioned within the recess 115, and may also remain in contact with the inner surface of the recess 115. Additionally, the check pin arm 143 is held in place by the ridge 134 such that the check pin 140 does not extend into the shell check pin cavity 114. Thus, when the key 130 is fully inserted, the check pin 140 does not cross the shear line 102, and the plug 120 is free to rotate. Rotation of the plug 120 causes the leaf spring 150 to elastically deform as the tip portion 151 travels along one of the tapered surfaces 116 and into contact with the shell inner surface 117. In the illustrated embodiment, the shell 110 includes two tapered surfaces 116 such that the plug 120 can be rotated in either direction. In other embodiments, the shell 110 may include only one tapered surface 116 such that the plug 120 is rotatable in only one direction. Furthermore, while the illustrated tapered surfaces 116 are rectilinear, it is also contemplated that one or both of the tapered surfaces 116 may be partially or entirely curved or curvilinear.

Figure 8:
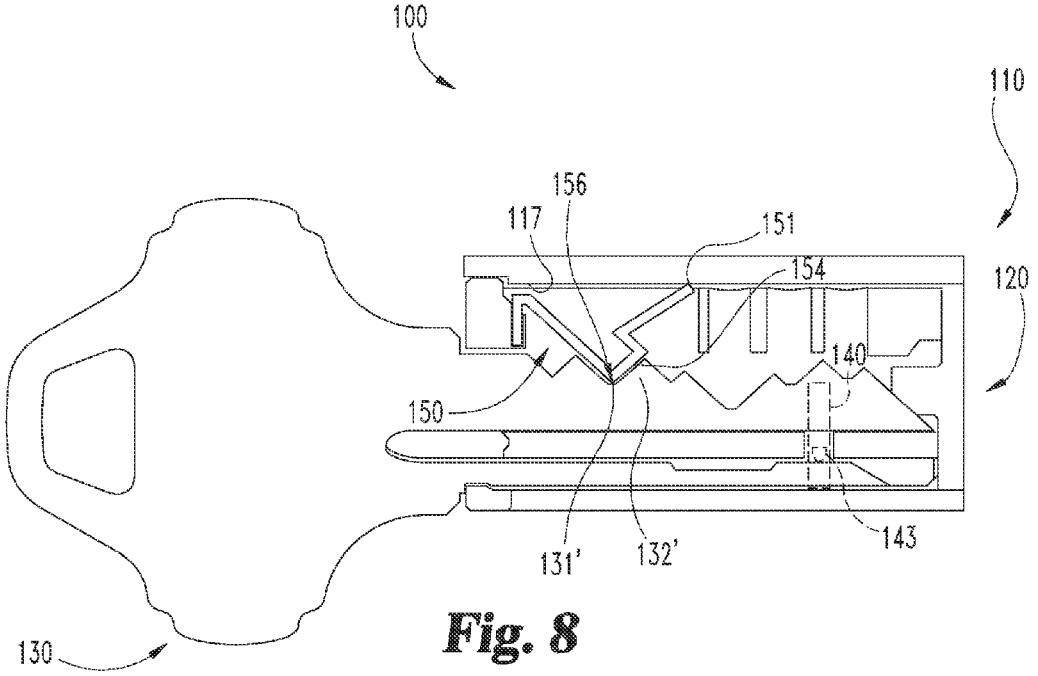
FIG. 8 depicts the lock cylinder in a fourth state in which the plug has been rotated to a rotated position.

FIG. 8 illustrates the cylinder 100 with the plug 120 positioned in a rotated position. In the interest of clearly illustrating the relevant features of the cylinder 100, the frame of reference remains with the plug 120 wherein it appears that the shell 110 has been rotated. In this state, the tip portion 151 is in contact with the shell inner surface 117, and the first leg 153 is arranged substantially perpendicular to the surface of the engagement tooth 132'. An attempt to extract the key 130 therefore results in the engagement tooth 132' exerting a force near the vertex 156 which is opposed almost entirely by the first leg 153. As such, the shell inner surface 117 exerts only a small force which is insufficient to cause significant deformation of the leaf spring 150. As can be seen from the foregoing, the compression and geometry of the leaf spring 150 prevents the key 130 from being removed during rotation of the plug 120. The key 130 therefore cannot be extracted until the plug 120 is returned to the home position, wherein the tip portion 151 can enter the recess 115 and the leaf spring 150 can pivot away from the key 130.

In certain circumstances, it may be preferable that the cylinder 100 be operable by each key in a family of keys, wherein each of the keys in the key family has a different top cut or key code. As such, the leaf spring 150 may be configured to provide the above-described functionality for keys having varying root depths at the engagement bitting 131' and engagement tooth 132'. Accordingly, the leaf spring 150 is flexible enough to elastically deform to a state similar to that shown in FIG. 8 when the root depth of the engagement bitting 131' is the maximum root depth of the engagement bitting 131' permitted in the key family. Furthermore, when the leaf spring 150 is in its natural state (FIG. 5), the distance between the vertex 156 and the opposing surface of the keyway 123 may be less than the smallest root depth of the engagement tooth 132' permitted in the key family. As such, the leaf spring 150 can retain the key 130 within the plug 120 as described above, even for the maximum and minimum root depths of the engagement bitting 131' and engagement tooth 132'.

The lock cylinder 100 provides access control and prevents the key 130 from being removed when the plug 120 is not in the home position. The cylinder 100 thus functions similar to that of other lock cylinders, but may be operable by any key that fits in the keyway 123. As is evident from the foregoing description, the cylinder 100 can be operated by any of a number of keys so long as the key has the proper structure to engage the means for selectively preventing rotation of the plug 120 (e.g., the check pin 140 or tumbler system).

Due to the configuration of the lock cylinder 100, only a small number of parts are required to execute the locking and unlocking action. That is to say, in order to provide the locking functionality, the cylinder 100 only needs to include the shell 110, the plug 120, the check pin 140 (or tumbler system), and the leaf spring 150. As such, assembly of the cylinder 100 is simplified, thereby leading to reduced cost and complexity.

In the illustrated embodiment, the check pin 140 engages only a single feature of the key 130 (i.e., the ridge 134), and is positioned toward the rear or distal end of the plug 120. As such, the check pin 140 ensures that the lock cylinder 100 cannot rotate until the key 130 is fully inserted (FIG. 7). In embodiments using a tumbler system, the tumbler system may likewise engage only a single feature of the key 130, such as one of the bittings 131 positioned near the tip of the key 130. It is also contemplated that the means for selectively preventing rotation of the plug 120 may engage more than one feature of the key 130, such as the ridge 134 and one of the bittings 131. In either case, the other bittings 131 remain available for different top cuts or key codes, so each of the keys which can operate the illustrated cylinder 100 can be cut to also operate standard lock cylinders in locations where higher security is required. Further details regarding this feature will now be described with reference to FIG. 9.

Figure 9:
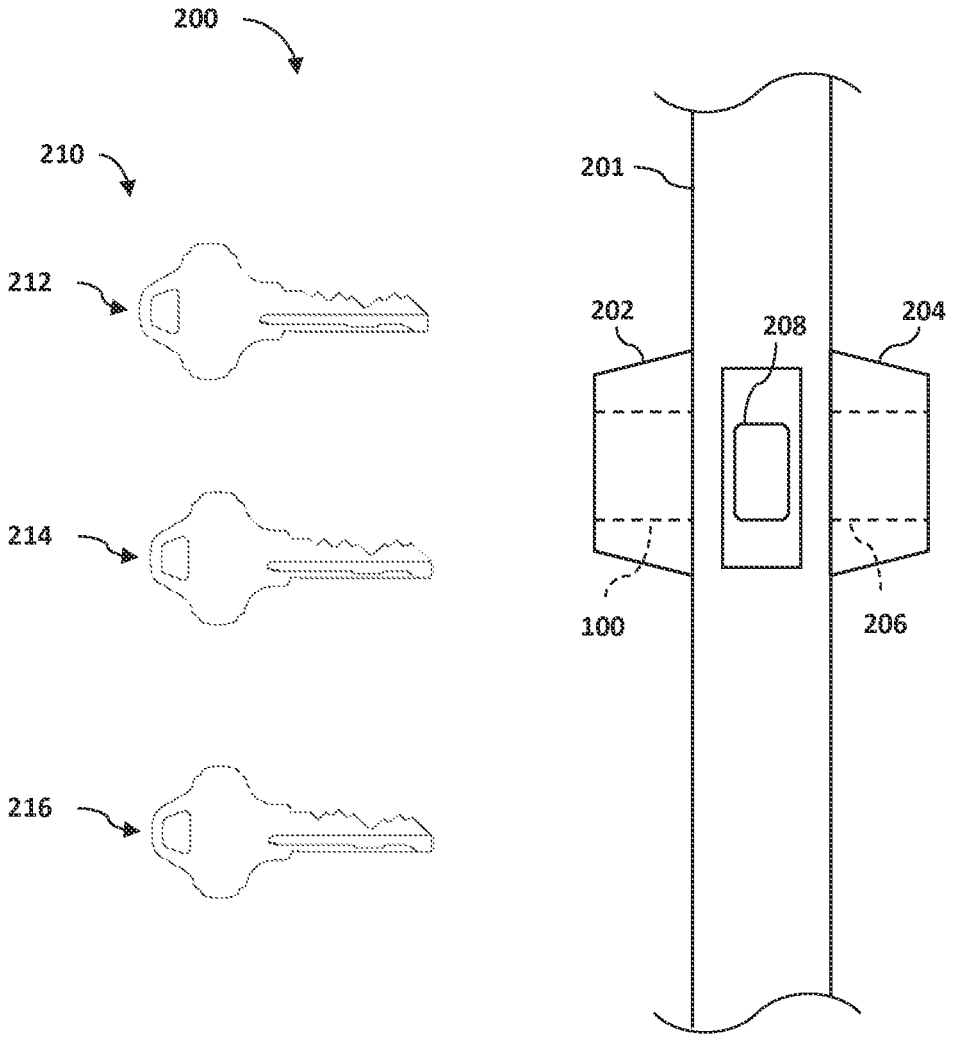
FIG. 9 depicts an access control system including the lock cylinder illustrated in FIG. 1.

FIG. 9 depicts an illustrative access control system 200 for controlling access to a door 201. The door 201 has mounted thereon an inner core housing 202 and an outer core housing 204. A lower-security lock cylinder in the form of the lock cylinder 100 is installed in the inner core housing 202, and a higher-security lock cylinder, such as a standard lock cylinder 206, is installed in the outer core housing 204. The higher-security lock cylinder 206 may include a shell, a plug seated in the shell, and a tumbler system operable to selectively prevent rotation of the plug with respect to the shell. A bolt 208 is operable in an extended locking position and a retracted unlocking position, and can be extended and retracted by operation of either of the cylinders 100, 206. In other words, the bolt 208 is connected to each of the lock cylinders 100, 206, and is configured to extend and retract in response to rotation of either of the plugs.

The access control system 200 also includes a key family 210 including a plurality of keys 212, 214, 216 having different top cuts or key codes. Due to the novel construction of the cylinder 100, each member of the key family 210 can operate the cylinder 100 to extend the bolt 208 and lock the door 201 from the inside of the room such as, for example, to prevent an intruder from entering. Because it may also desirable to prevent unauthorized entry into the room (i.e., to prevent theft or vandalism), the higher security standard lock cylinder 206 may be operable by only one of the keys in the key family 210, or by only a subset of the key family 210. The access control system 200 can therefore provide the necessary security for day-to-day operation, while also allowing a number of authorized personnel to lock down the room during emergency situations.

While the invention has been illustrated and described in detail in the drawings and foregoing description, the same is to be considered as illustrative and not restrictive in character, it being understood that only the preferred embodiments have been shown and described and that all changes and modifications that come within the spirit of the inventions are desired to be protected. It should be understood that while the use of words such as preferable, preferably, preferred or more preferred utilized in the description above indicate that the feature so described may be more desirable, it nonetheless may not be necessary and embodiments lacking the same may be contemplated as within the scope of the invention, the scope being defined by the claims that follow. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

What is claimed is:

1. A lock cylinder, comprising:

a shell including a generally cylindrical chamber and a recess including a tapered surface extending radially outward from an inner surface of the shell;

a plug disposed within the chamber and including a keyway and an opening connected to the keyway, wherein the opening is aligned with the recess in a home position of the plug, and the opening is not aligned with the recess in a rotated position of the plug;

a locking member configured to permit rotation of the plug from the home position upon insertion of a proper key into the keyway and to prevent rotation of the plug from the home position when the proper key is not inserted; and a leaf spring disposed at least partially within the opening and including a first portion extending radially inward into the keyway and a second portion extending radially outward toward the shell, wherein the leaf spring is connected at one end to the plug and is configured to elastically deform to a state in which a tip of the second portion is positioned within the recess in response to insertion of the proper key into the keyway;

wherein the tapered surface is configured to urge the tip radially inward and into contact with the inner surface of the chamber in response to rotation of the plug from the home position to the rotated position; and wherein the leaf spring is configured to permit removal of the key when the plug is in the home position and to prevent removal of the key when the plug is in the rotated position.

2. The lock cylinder of claim 1, wherein the first portion comprises a first leg, and the second portion includes:

a second leg arranged substantially perpendicular to the first leg, a third leg arranged substantially parallel to the first leg, and a fourth leg including the tip.

3. The lock cylinder of claim 1, wherein the first portion is arranged substantially perpendicular to a surface of a tooth on the proper key when the proper key is inserted into the keyway.

4. The lock cylinder of claim 1, wherein the locking member is configured to permit rotation of the plug from the home position only when the proper key is fully inserted.

5. The lock cylinder of claim 1, wherein the locking member comprises means for selectively preventing rotation of the plug with respect to the shell.

6. The lock cylinder of claim 1, wherein the locking member comprises a check pin operable in a blocking position wherein the check pin crosses a shear line of the cylinder to prevent rotation of the plug, and operable in an unblocking position wherein the check pin does not cross the shear line.

7. The lock cylinder of claim 6, wherein the check pin is configured to engage a ridge on a side of the proper key to move between the blocking position and the unblocking position.

8. An access control system, comprising:

a lock cylinder including:

a shell defining a plug chamber, a recess having a tapered surface, and a first cavity;

a plug positioned in the plug chamber, the plug including an opening, a second cavity , and a keyway connected to the opening and the second cavity, wherein the plug has a home position in which the opening is aligned with the recess and the second cavity is aligned with the first cavity such that a shear line is defined therebetween, and a rotated position in which the opening is not aligned with the recess and the second cavity is not aligned with the first cavity;

a resilient member disposed at least partially within the opening, the resilient member including a first portion extending radially inward into the keyway and a second portion extending radially outward toward the shell, wherein the resilient member is connected at one end to the plug, and wherein the resilient member comprises a unitary single-piece structure including the first portion and the second portion; and a locking member positioned at least partially in the second cavity, the locking member having a blocking state in which the locking member crosses the shear line and extends into the first cavity, and an unblocking state in which the locking member does not cross the shear line; and a key configured to move the locking member from the blocking state to the unblocking state upon insertion of the key into the keyway, the key including an edge cut comprising a plurality of bittings and a plurality of teeth, wherein one of the bittings is an engagement bitting and one of the teeth is an engagement tooth adjacent to the engagement bitting;

wherein, when the key is fully inserted into the keyway and the plug is in the home position, the locking member is in the unblocking state, the resilient member is engaged with at least one of the engagement bitting and the engagement tooth, and a tip of the second portion is positioned in the recess; and wherein rotation of the plug from the home position to the rotated position causes the tapered surface to urge the tip radially inward, thereby deforming the resilient member to a state in which the key cannot be removed from the plug.

9. The access control system of claim 8, further comprising a plurality of the keys, each of the plurality of keys including a different combination of bittings and teeth.

10. The access control system of claim 9, wherein the lock cylinder is installed on a first side of a door and is operable by each of the keys, and a second lock cylinder is installed on a second side of the door and is operable by at least one of the keys and is not operable by at least one other of the keys.

11. A system, comprising:

a lock cylinder comprising:

a shell including a chamber defined in part by an inner surface of the shell, and a recess defined in part by a tapered surface extending radially outward from the inner surface of the shell;

a plug including an opening aligned with the recess, and a keyway in communication with the opening;

a leaf spring including a base portion coupled to plug at a proximal side of the recess, a first leg extending distally and radially inward and into the keyway, and a tip portion extending radially outward toward the recess; and a locking member having a blocking position in which the locking member prevents rotation of the plug with respect to the shell, and an unblocking position in which the locking member does not prevent rotation of the plug with respect to the shell, wherein a portion of the locking member extends into the keyway;

wherein the leaf spring is configured to elastically deform to a state in which the tip portion extends into the recess in response to insertion of a key into the keyway; and wherein the locking member is configured to move from the blocking position to the unblocking position in response to insertion of the key into the keyway.

12. The system of claim 11, further comprising the key.

13. The system of claim 12, wherein the key includes a leaf spring engagement section and a locking member engagement section, wherein when the key is fully inserted, the leaf spring engagement section is in contact with the leaf spring and the locking member engagement section is in contact with the locking member.

14. The system of claim 13, wherein the leaf spring engagement section is formed on an edge of the key, and the locking member engagement section is formed on a side surface of the key.

15. The system of claim 13, further comprising a plurality of the keys, wherein the leaf spring engagement section of a first of the keys has a first root depth, and the leaf spring engagement section of a second of the keys has a second root depth which is different from the first root depth.

16. The system of claim 15, further comprising:

a second lock cylinder operable by the first key and not operable by the second key; and a bolt operably connected to each of the lock cylinders and configured to extend and retract in response to operation of each of the lock cylinders.

17. The system of claim 11, wherein the locking member includes means for selectively preventing rotation of the plug with respect to the shell.

18. The system of claim 11, wherein the leaf spring further includes a second leg extending distally and radially outward from the first leg, and a third leg extending proximally and radially outward from the second leg, and wherein the tip portion extends distally and radially outward from the third leg.

19. The system of claim 18, wherein the key includes an engagement tooth, and wherein with the key fully inserted into the keyway, a surface of the engagement tooth engages the first leg, and the second leg is arranged substantially perpendicular to the surface.

* * * * *